US005379483A

United States Patent [19]

Pino

[11] Patent Number: 5,379,483

[45] Date of Patent: Jan. 10, 1995

[54] VACUUM CLEANER HAVING A TOOL ATTACHED TO THE NOZZLE

[75] Inventor: Giovanni Pino, Grand Rapids, Mich.

[73] Assignee: Bissell, Inc., Grand Rapids, Mich.

[21] Appl. No.: 944,875

[22] Filed: Sep. 14, 1992

Related U.S. Application Data

[63] Continuation-in-part of Ser. No. 917,820, Jul. 21, 1992, Pat. No. 5,337,443.

[51] Int. Cl.[6] ..... A47L 9/02

[52] U.S. Cl. ..... 15/323; 15/350; 15/344

[58] Field of Search ..... 15/323, 344, 350, 415.1, 15/416, 420, 422

[56] References Cited

U.S. PATENT DOCUMENTS

| | | | |
|---|---|---|---|
| D. 288,971 | 3/1987 | Hobulin et al. | D32/18 |
| 2,703,905 | 3/1955 | Faith-ell | 15/422 |
| 2,975,456 | 3/1961 | Davidson | 15/422 |
| 3,029,461 | 4/1962 | Osborn | 15/350 |
| 3,872,538 | 3/1975 | Crouser | 15/323 |
| 3,955,237 | 5/1976 | Chateauneuf et al. | 15/323 |
| 4,541,142 | 9/1985 | Pudwill | 15/323 |
| 4,573,237 | 3/1986 | Kochte et al. | 15/344 |
| 4,720,890 | 1/1988 | Jacob | 15/323 |
| 4,761,850 | 8/1988 | Romeo et al. | 15/323 |
| 5,046,218 | 9/1991 | Cerri | 15/416 |
| 5,060,341 | 10/1991 | Nelle | 15/344 |

*Primary Examiner*—David A. Scherbel
*Assistant Examiner*—James F. Hook
*Attorney, Agent, or Firm*—Price, Heneveld, Cooper, DeWitt & Litton

[57] ABSTRACT

A vacuum cleaner convertible between a hand-held vacuum and a stick-type vacuum including a housing having a rondure first end and narrowing to a generally oblate, low profile nozzle at a second end, defining an opening in fluid communication with an interior of the housing. A releasably extensible dirt cup is slidably disposed within the opening in the second end and adapted to move between a retracted position within the housing and an extended position from the housing. The free end of the dirt cup is adapted to detachably retain a floor cleaning tool having a pivoting cleaning head for use on floors or other surfaces to be cleaned. The housing contains a vacuum source for drawing high velocity air into the elongate dirt cup through the floor cleaning tool and/or free end of the elongate dirt cup so as to entrain dirt and debris and capture it within the dirt cup. The dirt cup is cleaned by withdrawing it from the end of the nozzle and removing the spun-bonded filter assembly before pouring the dirt cup contents into a separate container. The low profile housing, together with the extensible dirt cup and detachable floor cleaning tool, easily adapts to a variety of cleaning needs while simultaneously providing a lightweight and ergonomically balanced cleaning tool.

12 Claims, 7 Drawing Sheets

VACUUM CLEANER HAVING A TOOL ATTACHED TO THE NOZZLE

CROSS REFERENCE TO RELATED APPLICATION

This is a continuation in-part of U.S. patent application Ser. No. 917,820, filed Jul. 21, 1992, 1992, U.S. Pat. No. 5,337,443.

FIELD OF THE INVENTION

This invention relates generally to vacuum cleaners, and particularly to vacuum cleaners convertible from a hand-held vacuum to a stick-type vacuum cleaner.

BACKGROUND OF THE INVENTION

A variety of different dry-type vacuum cleaners are available for a variety of uses ranging from heavy duty rug and carpet cleaners, light duty rug and carpet cleaners for cleaning small spills and crumbs, and compact hand-held cleaners for cleaning cushions, pillows, stair treads and the like. There have also been developed cleaners particularly designed or equipped with conversion tools to be used for special purposes such as removal of spider webs near the ceiling, drapery valences, and other hard to reach areas.

In recent years, due to the introduction of plastics and substantial improvements in the design of electric motors for this type of equipment, the bulk and weight of these machines have been reduced substantially. Also, the development of compact rechargeable, heavy duty batteries has made possible the so-called "cordless vacuum cleaner." However, there remains the problem that the machines are limited to one or two functions. For other functions, it has been necessary to have a second tool or a bulky and clumsy conversion kit. Such tools and conversion kits are necessary because the vacuums are too large or bulky to lift above the head to clean out of reach areas or tight areas.

Stick vacuums, that is hand-held vacuums attached to the end of a rod, were designed to be used to clean carpets or floors from a standing position, or to clean hard to reach areas such as ceilings, drapery valences, and the like. However, a majority of the stick-vacs proved awkward to handle since substantially all of the weight of the vacuum was disposed at the far end of the wand. When used above or off the floor, the mass of the vacuum at the end of the wand requires the operator to exert a great deal of energy in suspending the vacuum at the end of the wand. Moreover, accessory cleaning tools were stored separate from the portion of the vacuum being held by the user, making them rather awkward to access.

SUMMARY OF THE INVENTION

The instant invention provides a vacuum cleaner convertible from a lightweight and maneuverable hand-held vacuum to an extended stick-like vacuum to clean floors from a standing position and otherwise inaccessible areas. In the extended position, the nozzle is sufficiently strong to support the weight of the vacuum. Moreover, the vacuum cleaner is adapted to receive a floor cleaning tool or head which may be used in either the extended or retracted position, depending upon the desired cleaning task to be performed. The floor cleaning tool conveniently carries at least one accessory cleaning tool thereon.

The vacuum cleaner includes a low profile, oblate housing having an opening in a first end which extends substantially the length of the housing, and having a shape substantially identical to the exterior shape of the housing. The housing is enlarged toward the second end to contain a motor driven fan for drawing air into the first end and out the second end of the vacuum housing. Telescopically received within the first end of the housing is an elongate tubular dirt cup adapted to slide therein between a first retracted position and a second extended position. The tubular dirt cup may be locked into any one of a number of positions between and including the fully retracted and extended positions. The dirt cup includes a removable filter at one end and a flapper valve at an opposite end adapted to prevent the debris from falling back out the dirt cup once captured. A handle extending from the top of the vacuum cleaner housing provides a compound grip to optimally position the center of gravity of the vacuum when used as a hand-held vacuum or in the extended position as a stick-like vacuum. The angles of the two grip positions and handle contours are ergonomically designed so the operator may comfortably use the vacuum.

The vacuum cleaner also includes a detachable floor cleaning tool having a pivotal cleaning head designed to engage the surface to be cleaned. An accessory such as a crevice tool is detachably coupled, and nested in a neck portion of the floor cleaning tool, for easy access by the user. The accessory is designed to be attached to the end of the elongate dirt cup and fully movable therewith.

The instant invention provides numerous advantages over prior hand-held and stick-like vacuum cleaners, including the ergonomic design for the wide range of readily convertible operating positions, as well as the low profile nozzle to access tight or otherwise inaccessible areas. The extensible dirt cup offers the advantage of a stick vacuum without the stick, and always provides the same travel distance for debris entering the vacuum before it is captured by the filter regardless of whether in the retracted or extended position, making for a more efficient vacuum. Moreover, the short distance to the dirt cup reduces the risk that debris may clog or block the intake.

Additional advantages include a convertible hand vacuum/stick vacuum having a floor cleaning tool which carries accessories for special cleaning applications. The accessories are easily accessed by the user and are aesthetically incorporated in the overall function and design. The improved filter design also improves operational and cleaning functions. The combination of the dirt cup/extension into the extensible dirt cup reduces the need for parts in assembly as well as reduce replacement part inventory, while also providing an attractive, versatile and easily maneuverable design. The low profile and linear alignment of the components may be formed from inexpensive materials and easily assembled, thus providing an inexpensive yet efficient and versatile vacuum cleaner.

BRIEF DESCRIPTION OF THE DRAWINGS

A better understanding of the objects, benefits and advantages of our invention may be obtained from the appended detailed description and drawings, wherein.

DETAILED DESCRIPTION OF THE THE PREFERRED EMBODIMENTS

Figure 1:
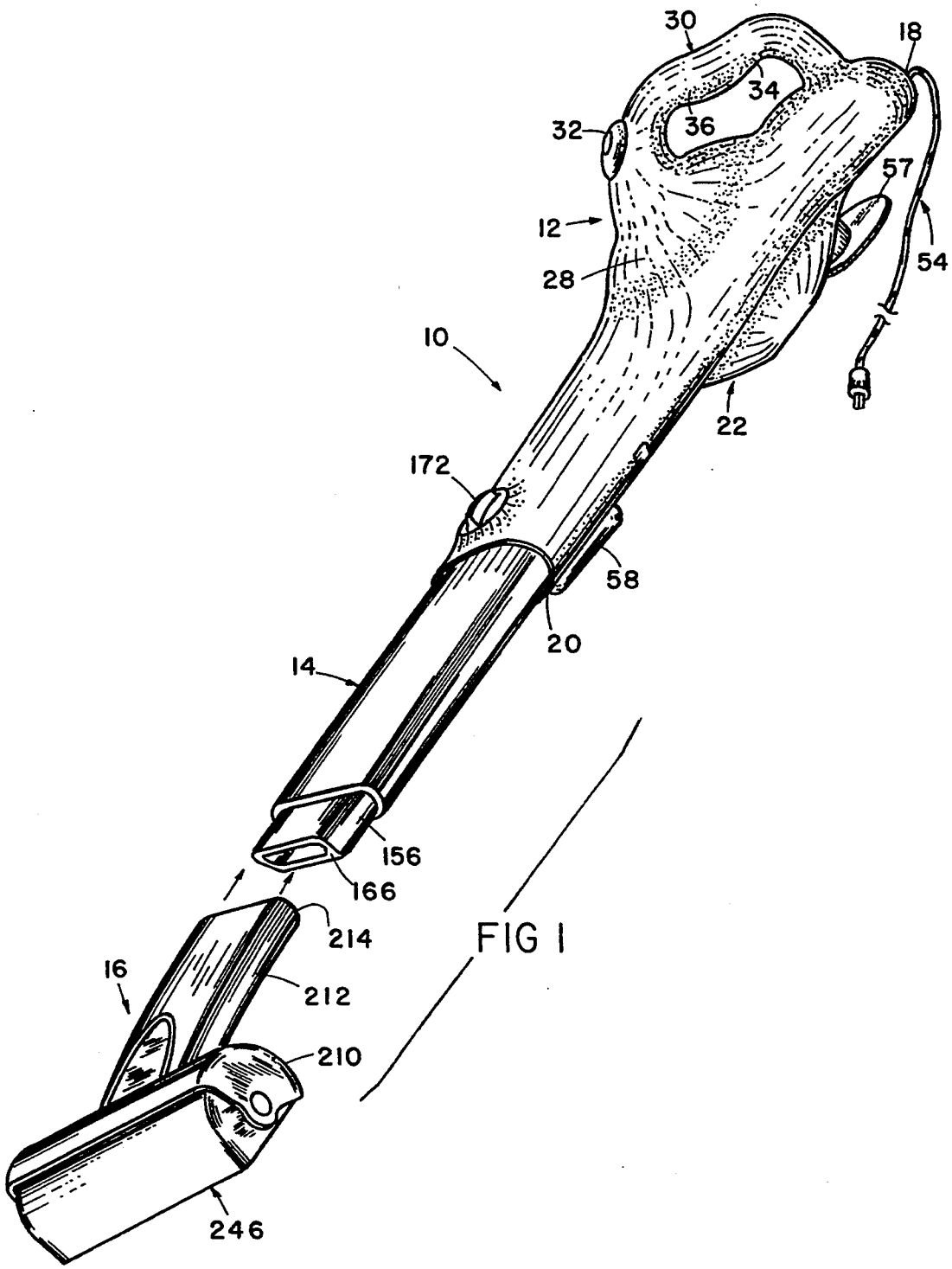
FIG. 1 is an oblique view of one embodiment of the invention.

For purposes of the following description, the terms "upper," "lower," "right," "left," "rear," "front," "vertical," "horizontal" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are not be be considered as limiting, unless the claims expressly state otherwise.

Figure 2:
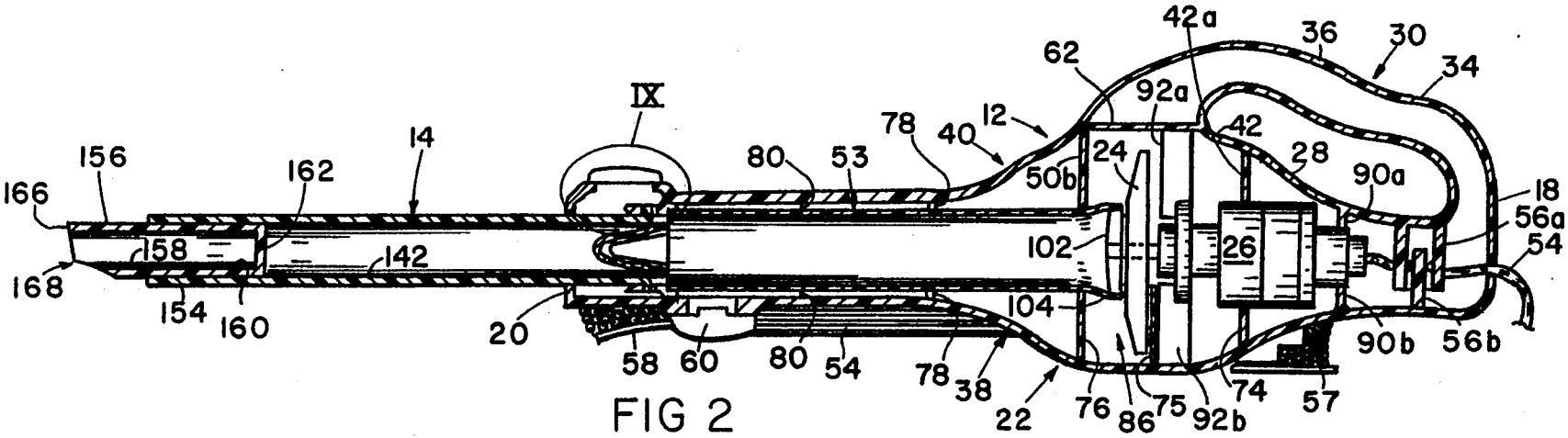
FIG. 2 is a side, cross-sectional view taken along lines II—II in FIG. 1.

Throughout the following description referring to the many drawing figures, like reference numerals will be used to indicate like components, wherein FIG. 1 illustrates one embodiment of a vacuum cleaner 10 of this invention including an elongate, low profile, oblate housing 12, a variably extensible dirt cup 14 and a detachable floor cleaning tool 16. Housing 12 has a rear and front end 18 and 20, respectively, defining a longitudinal axis A—A extending therebetween. Proximate back end 18 and located approximately one-quarter of the length of housing 12 is an enlarged, rondure, or bulbous portion 22 adapted to accommodate a centrifugal fan 24 (FIGS. 2 and 3) and an air-cooled electric motor 26 therein. From rondure or enlarged portion 22 to front end 20, the size of housing 12 is reduced forming a low profile, elongate nose portion 23 having a substantially oblate or elliptical cross section perpendicular to longitudinal axis A—A of housing 12. The low profile, oblate portion or nose 23 and dirt cup 14 provides sufficient cross-sectional area for good air flow while simultaneously allowing access of dirt cup 14 and nose portion 23 to otherwise inaccessible areas.

Integral with housing 12 and extending from an upper surface 28 of rondure portion 22 is a handle 30 rejoining housing 12 near back end 18. Handle 30 includes a switch 32 for turning motor 26 on and off, and a compound angle forming two ergonomically designed grip positions 34 and 36. The angular orientations of the two grip positions 34, 36 are adapted to position the vacuum's center of gravity either below or ahead of the user's hand while the vacuum is used as a hand-held vacuum or as a stick-like vacuum. For example, grip position 34 may be inclined between 5 degrees and 15 degrees from longitudinal axis A—A to provide a grip position suitable for use as a stick vacuum. Grip position 36 may be inclined between 10 degrees and 25 degrees with respect to longitudinal axis A—A to provide an ergonomic grip when used as a hand-held vacuum.

Figure 7:
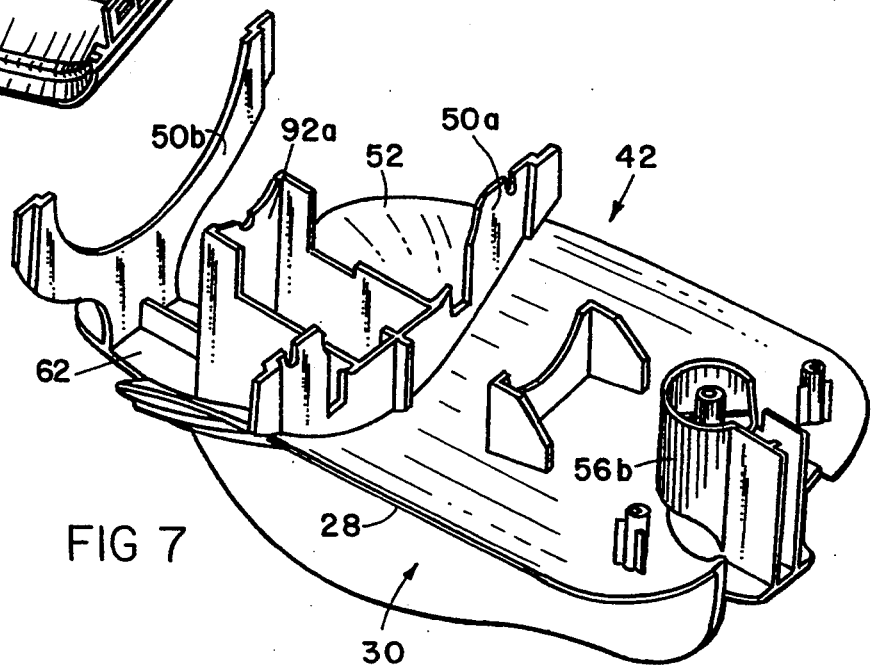
FIGS. 6 and 7 are oblique views of an insert for the upper one-half of the housing.
Figure 6:
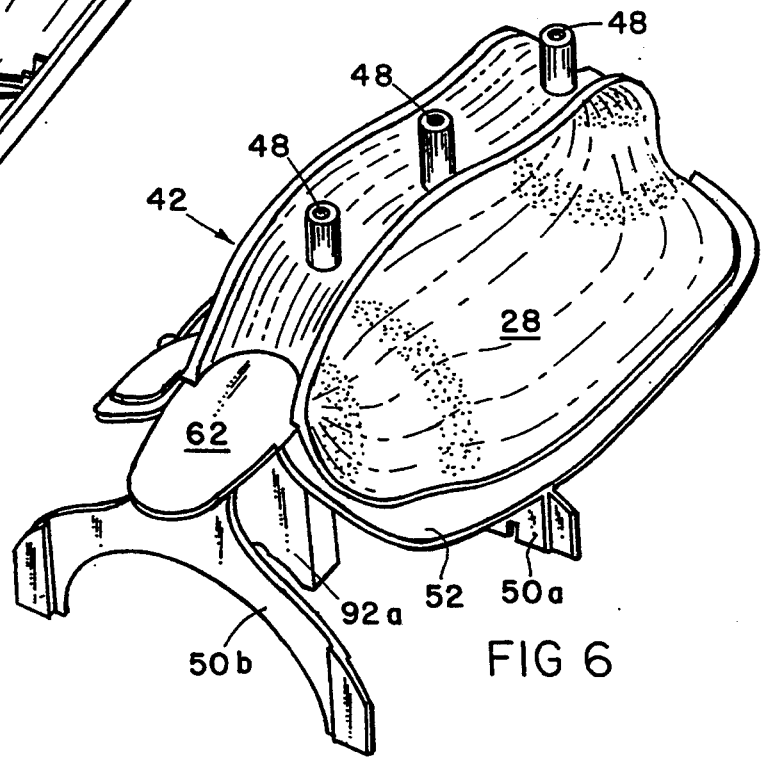
Figure 8A:
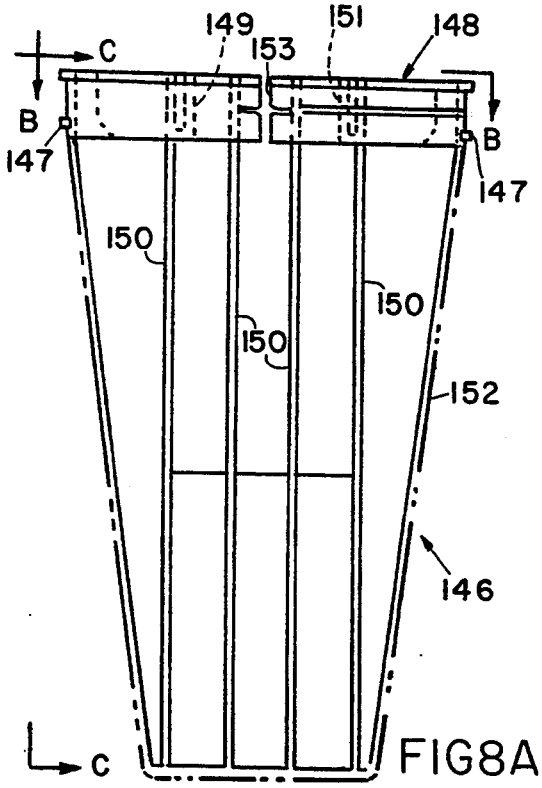
FIGS. 8A-8D illustrate one embodiment of a filter assembly for use in this invention.
Figure 8D:
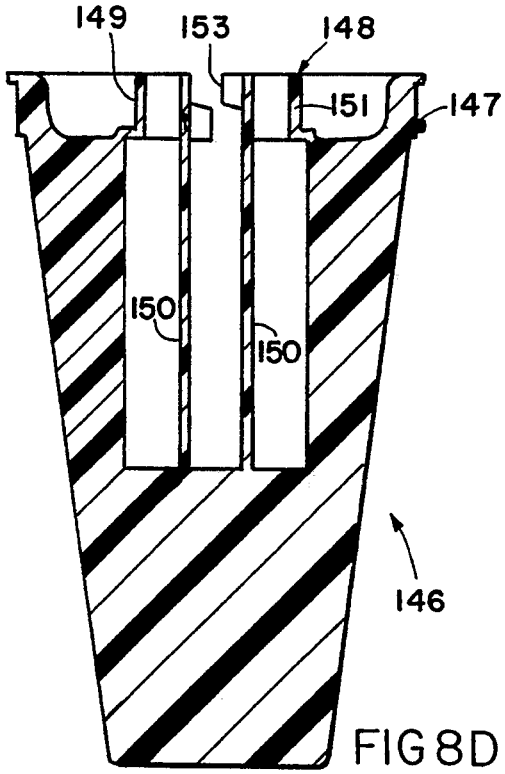
Figure 8C:
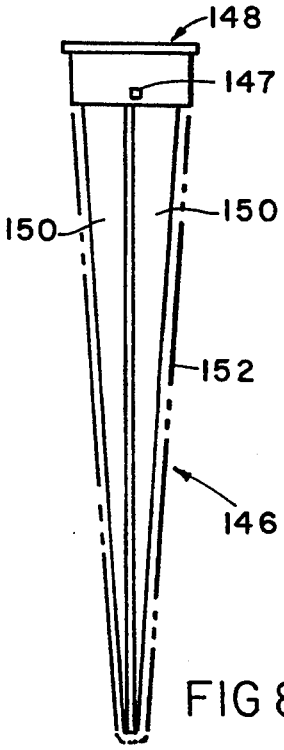
Figure 8B:
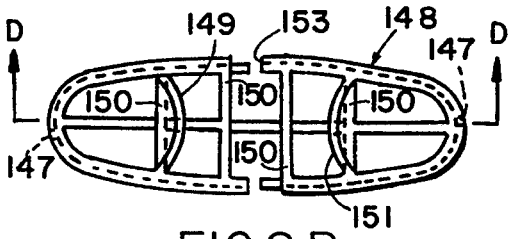

Housing 12 is preferably formed from a high impact polystyrene plastic (HIPP) or ABS plastic in three separate pieces: one forming lower half 38 and two parts, upper housing 40 and handle insert 42, forming the upper half. Handle insert 42 is adapted to fit within opening 44 of upper housing 40 to complete the lower side of handle 30 and the upper surface of bulbous portion 22 for the fan and motor 24, 26 (FIGS. 6 and 7). Handle insert 42 and upper housing 40 may be held together by post and socket fasteners 46, 48, respectively, extending from the respective portions comprising handle 30. Ribs 50 extending from lower surface 52 of handle insert 42 extend laterally beyond the portion comprising outer surface 28 of rondure housing 22, thus preventing it from extending beyond the remainder of outer surface 28 of housing 40. Each piece is preferably formed using well-known injection molding techniques.

An electric cord 54 exiting back 18 of housing 12 is used to supply AC current to motor 24. A first end of cord 54 is secured within housing 12 by anchor 56*a*-56*b* (FIGS. 4 and 7) such that any tensional force applied to cord 54 will not break the electrical coupling to motor 24. Because of the compact nature of housing 12, it is preferred that cord 54 be stowed on the exterior of housing 12.

Back 18 of lower housing 38 is adapted to receive a plate 57 (FIGS. 1 and 2) at the base of rondure portion 22, disposed parallel to the longitudinal axis A—A of housing 12. Cord 54 is also wrapped about a hook 58 extending from a disc 60 rotatably coupled with lower housing 38 proximate front 20. Disc 60 includes a shaft 62 journaled within a hole in lower housing 38 adapting disc 60 to rotate about the shaft. Cord 54 may be wrapped around plate 56 and hook 58 and retained in place using a conventional catch (not shown) formed in the plug and adapted to pinch an adjacent portion of the cord. Cord 54 may be quickly released by rotating disc 60 such that hook 58 is positioned toward the back end of housing 12 and allowing cord 54 to fall free.

Although this invention has been described with an electric cord stowed on the exterior of the vacuum housing, it is contemplated that back 18 of housing 12 may be slightly modified to accommodate a cord reel well-known in the art. It is further contemplated by the invention that AC power may be substituted by a DC power supply consisting of rechargeable batteries. Such a DC power supply may be easily accommodated within housing 12 as well as the appropriate circuitry used to recharge the cells. Each of the above modifications may be made using conventional and readily available materials.

The interior surfaces 70 and 72 (FIGS. 4 and 5) of upper and lower housings 38 and 40, respectively, generally conform to the external shape, periodically reinforced and strengthened by ribs or bulkheads 74-84 (FIGS. 2-5). Each rib extends substantially perpendicular to the longitudinal axis of housing 12. Ribs 50*a* and 50*b*, together with tongue 62 extending from insert 42, cooperate with ribs 74, 76 extending from lower housing 38 to form a chamber 86 enclosing fan 24. Motor 26 is supported within housing 12 by ribs and/or mounts such as 50*a*, 74, 90*a*-90*b* and 92*a*-92*b* so that fan 24 is unencumbered and free to rotate within chamber 86.

Centrifugal fan 24 located within chamber 86 is oriented to draw air in through extensible dirt cup 14 and out through perforations 100 in back 18 of lower housing 38. Fan 24 is preferably powered by an electric motor 26, such as made by Ametek's, Lamb Electric Division of Ohio. Motor and fan 24, 26 are supported within chamber 86 such that an air inlet 102 of fan impeller 24 is concentrically received within one end 104 of casing 53. Casing 53 extends from end 104 immediately adjacent impeller 24, terminating at its opposite end 106 just inside end 20 of housing 12.

Figure 4:
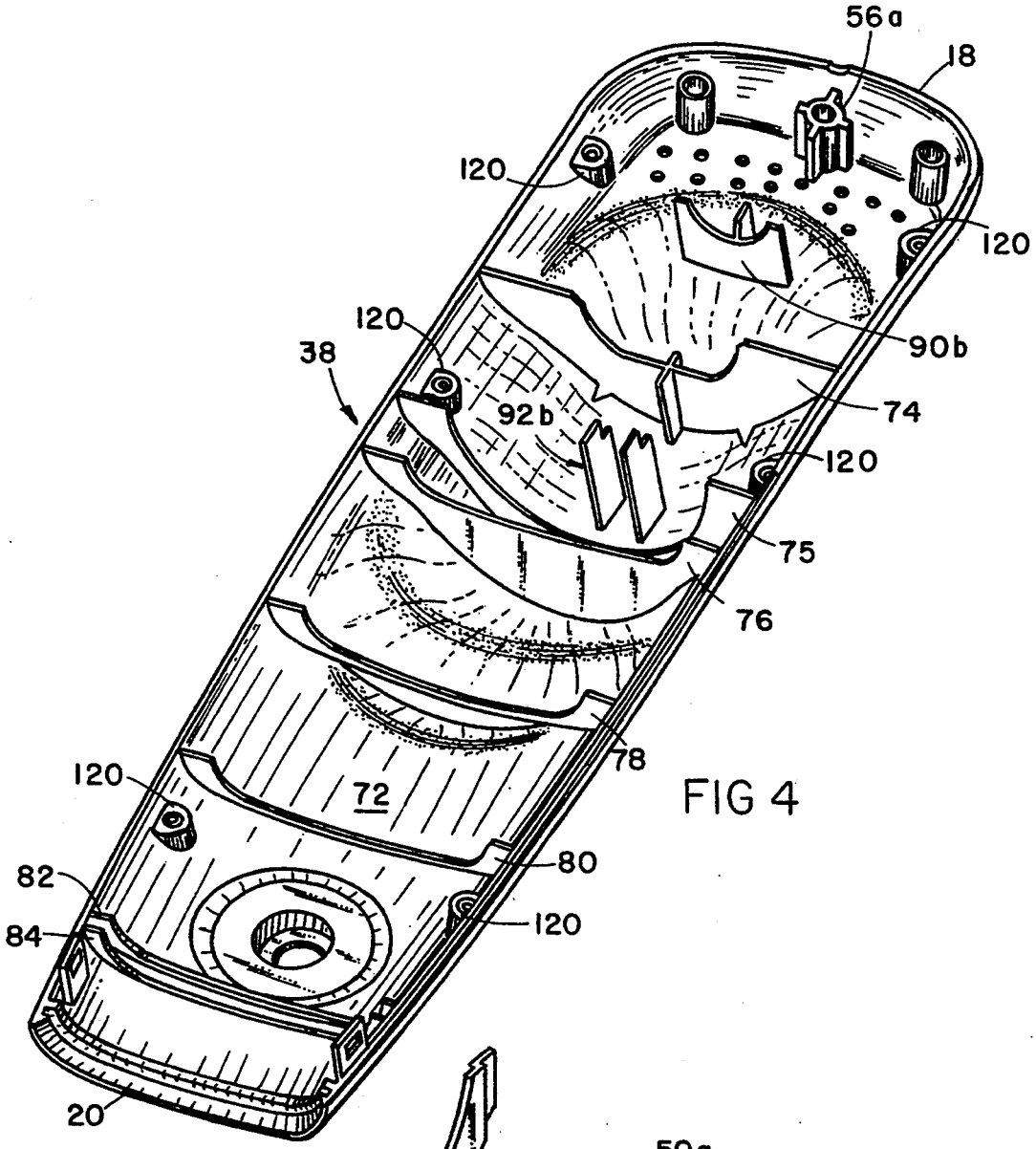
FIG. 4 is an oblique view of the lower one-half of the housing.
Figure 5:
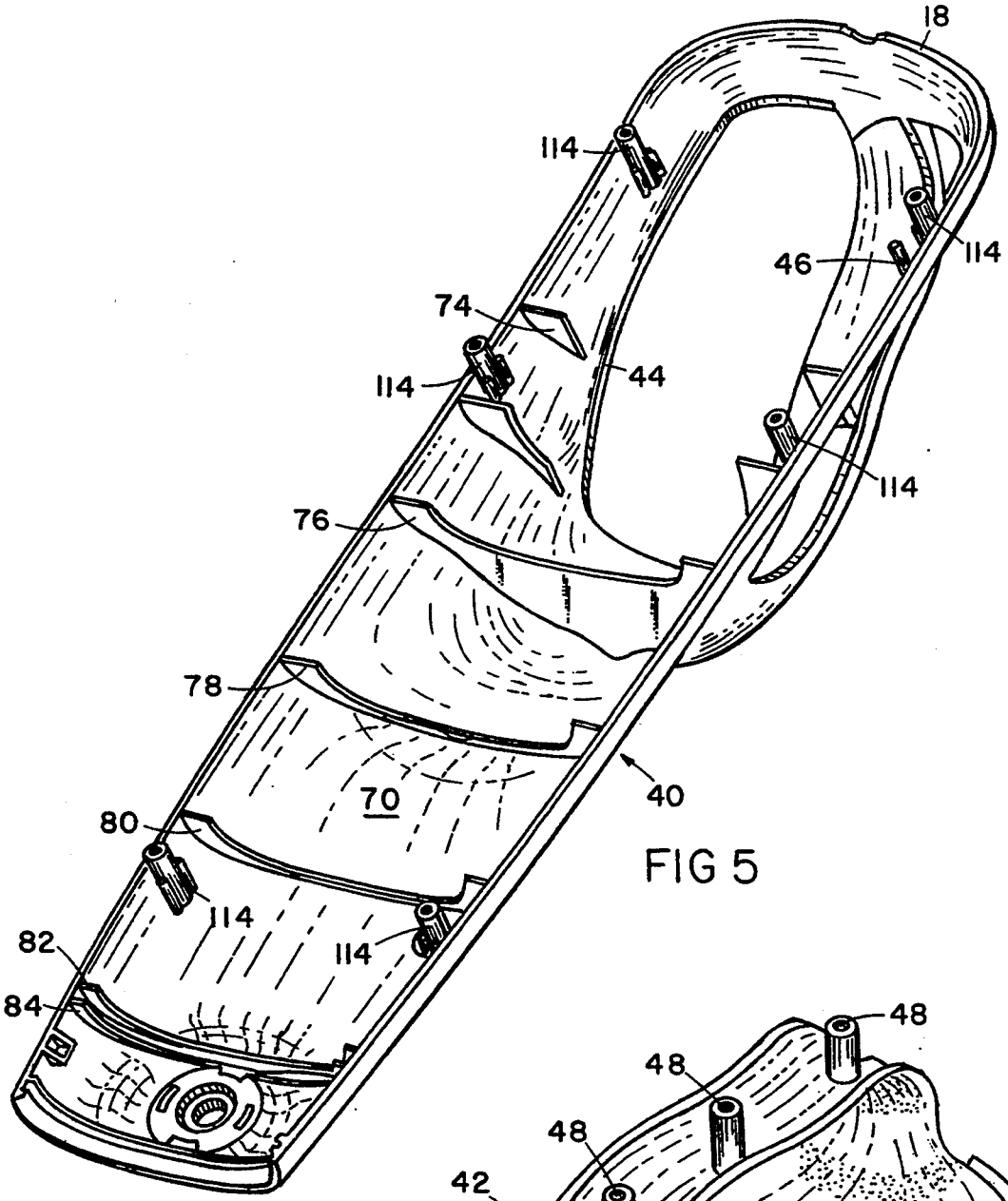
FIG. 5 is an oblique view of the upper one-half of the housing.

Casing 53 is centered within housing 12 and retained therein by ribs 76–84 defined in each half 38, 40 of housing 12. Ribs 82 and 84 (FIG. 9) are specifically adapted to engage grooves 108 extending around outer surface 110 of casing 53 near end 112. Ribs 76–84 and upper and lower housing 38 and 40 are specially designed to be clamped together about fan 24, motor 26 and casing 53 in registered alignment by bosses 114 receiving threaded fasteners extending through sockets 120 in lower housing 38 (FIGS. 4 and 5).

Figure 3:
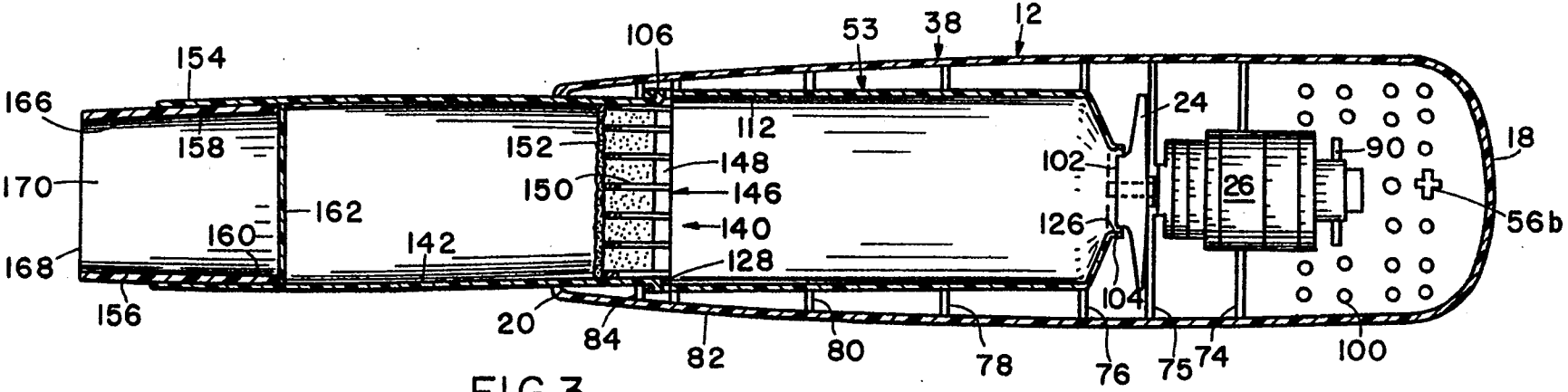
FIG. 3 is a cross-sectional view taken along lines III—III in FIG. 2.

The geometry of casing 53 changes from end-to-end (FIG. 3). At end 104, opening 126 is generally circular, having an inside diameter slightly larger than the outside diameter of air inlet 102 of impeller 24. It is preferred that substantially close tolerances be maintained between the outside diameter of impeller air inlet 102 and the inside diameter of opening 126 to assure efficient air flow. Casing 53 tapers rapidly outward from end 104 in a horizontal direction to obtain a maximum cross-sectional area within the oblate shape of housing 12 toward end 20. Slidably received in end 106 is the extensible dirt cup 14 adapted to extend from and retract within the casing. End 106 has an opening 128 shaped substantially identical to the outer surface 130 of dirt cup 14 with at least a portion of end 106 (FIG. 9) having ramping surfaces 134, 136, each adapted to glide up and over dirt cup end 140.

The inner surface 112 of casing opening 128 fits closely with outer surface 130 of dirt cup 14 to provide a substantially airtight seal. However, if desired, a gasket or sealing material (not shown) may be fixed along either ramp surface 134 or 136, or along any other portion of casing 53 or housing 12 in contact with outer surface 130 of dirt cup 14 to form the seal. The gasket or seal may also act as a bearing surface to reduce the friction associated with the sliding motion of dirt cup 14 within casing 53. Both casing 53 and dirt cup 14 may be formed from a polymeric material using well-known molding techniques to produce the inner passages and openings.

Dirt cup 14 has a tubular inner wall 142 forming a passage extending the length of the dirt cup and concentric with the longitudinal axis A—A of vacuum 10. One end 140 of dirt cup passage 142 is adapted to receive a filter assembly 146 (FIGS. 8A–8D) including a split-oval frame 148 having a plurality of tapered ribs 150 extending perpendicular therefrom. Frame 148 is fitted with a spun-bonded polypropylene filter 152 which may be pleated or sewn together to form a pocket for each rib 150, effectively increasing the surface area of filter 152 to trap dirt and debris. Filter assembly 146 is disposed within passage 142 such that ribs 150 are oriented toward the opposite end 154 of dirt cup 14. Filter assembly 146 may be retained within end 140 by locking tabs 147 extending from each apex of the generally elliptical frame adapted to engage complimentary slots or notches formed on the inside of dirt cup end 140. Filter assembly 146 may be disengaged from end 140 by pinching ribs 149 and 151 together, closing gap 153 and withdrawing locking tabs 147 from dirt cup end 140.

End 154 of dirt cup 14 is fitted with an insert 156 having an external shape substantially similar to the oblate or elliptical transverse section exhibited by dirt cup 14 and front end 20 of housing 12. However, with respect to insert 156, the external dimensions preferably do not exceed the internal dimensions of passage 142 in order to be telescopically received by floor cleaning tool 16, described in greater detail below. Insert 156 includes a passage 158 extending therethrough parallel to, and preferably concentric with longitudinal axis A—A of vacuum 10. End 160 disposed within passage 142, is adapted to retain a flapper valve 164 adapted to seat passage 158 with flow in a single direction. The nozzle end 166 of insert 156 includes an end face 168 and contains an opening or orifice 170 to passage 158. Nozzle end face 168 is angled between 35 degrees and 55 degrees with respect to longitudinal axis A—A, generally placing it parallel to the surface to be cleaned with the operator holding either one of the two grip positions 34, 36 on handle 30.

Figure 9:
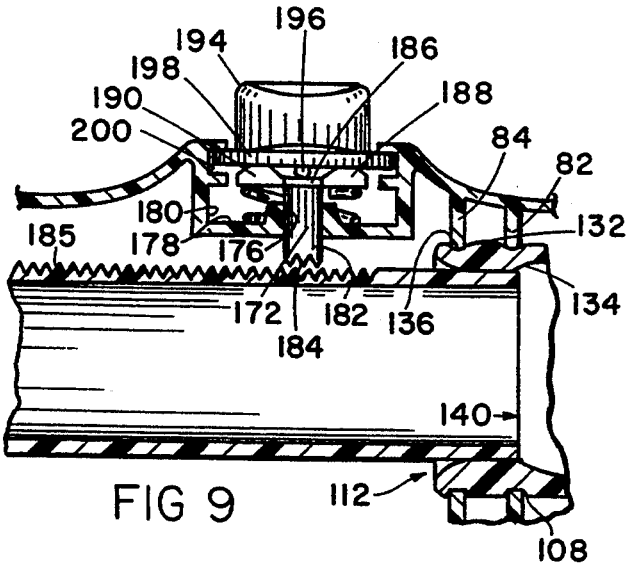
FIG. 9 is an enlarged, fragmentary side cross-sectional view of one embodiment of a locking mechanism.
Figure 10:
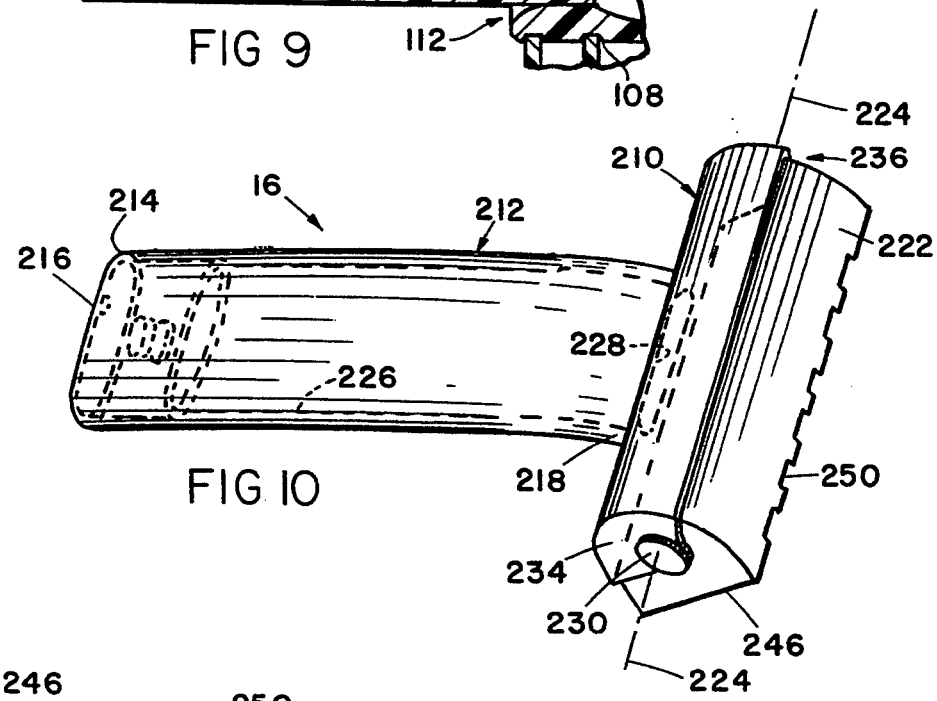
FIGS. 10-14 generally illustrate one embodiment of a floor cleaning and accessory tool.

Dirt cup 14 is adapted to slidably extend from and retract within casing 53. To maintain any one position, a locking mechanism 172, as shown in FIG. 9, extends through housing 12 proximate front end 20 and includes a plunger 174 extending through a hole 176 defined in the bottom 178 of a cylindrical recess or cavity 180 formed within housing 12. Tip 182 of plunger 174 includes serrations 184 adapted to engage serrated grooves 185 formed along the outer surface 130 of dirt cup 14. An opposite end 186 of plunger 174 has a flange or plate 188 containing a cam 190 along an upper surface. Disposed above flange 188 and cam surface 190 is a knob 194 having a lower cam surface 196 adapted to engage cam 190. Knob 194 also includes a flange 198 extending around its perimeter adapted to engage a retaining channel 200 which holds knob 194 against cam surface 190 of plunger 174. Rotation of knob 194 engages cam surfaces 190 and 196, forcing plunger 174 downwardly against spring 208 and forcing tip 182 against serrated grooves 185 in dirt cup outer surface 130. Friction between tip 182 and serrated grooves 185 in outer surface 130 is sufficiently strong to retain dirt cup 14 in position while vacuum 10 is in use. Rotating knob 194 in an opposite direction disengages cam surfaces 190 and 196 and allows spring 208 to bias plunger 174 upwardly to disengage tip 182 from dirt cup 14.

In one embodiment, vacuum 10 includes a detachable floor cleaning tool 16 (FIGS. 1 and 10–14) having a foot 210 disposed at one end of an elongate neck 212. The exterior of neck 212 is substantially identical in shape to the exterior shape of dirt cup 14. At an upper end 214, neck 212 has a cavity 216 adapted to firmly receive nozzle 166 of insert 156 and retain tool 16 thereon. The opposite end 218 of neck 212 comprises a shroud 220 about a floor engaging head 222 pivotal about an axis 224. A passage 226 within neck 212 extends the entire length thereof from the bottom of cavity 216 to an opening 228 within shroud 220. Tool 16 may be formed from the same material as casing 53 using the same molding technique.

Figure 11:
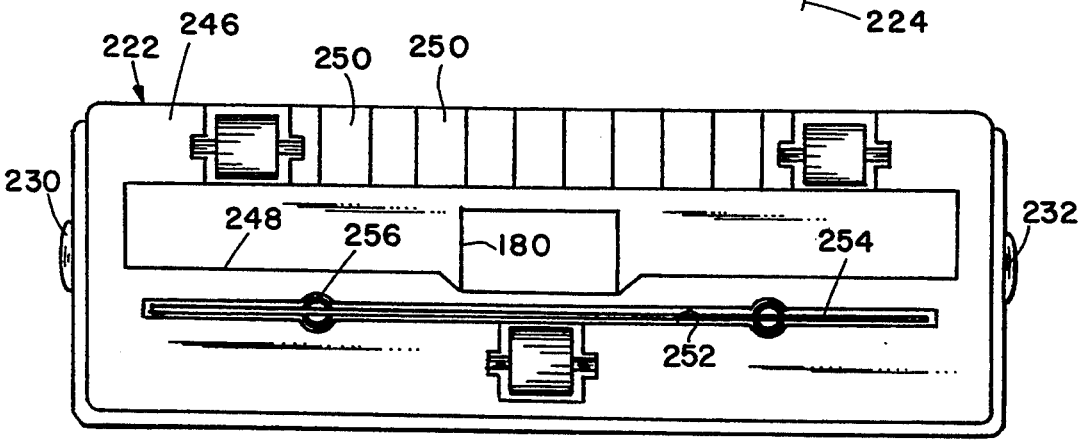

Floor engaging head 222 within shroud 220 is substantially a cylinder having outside dimensions substantially identical to the inside dimensions of shroud 220 and is pivotally coupled at its ends 230 and 232 to shroud ends 234 and 236 (FIG. 11). Head 222 is preferably formed as two pieces adapted to snap-fit together. Each half of head 222 may be made from injection molded ABS or high impact, high heat polystyrene plastic. Head 222 has a flat 246 parallel to axis 224 and adapted to engage the floor (FIG. 11). At least one channel 248 is formed therein, extending along the length and increasing in depth from its outer ends 230 and 232 toward a centerline. Channel 248 converges to a throat 180 extending perpendicular to axis 224 and in fluid communication with passage 226 extending from shroud 220. Additional channels 250 may be formed within flat 246 extending from the external surface of head 222 and connected to channel 248. Channels 248 and 250 within floor engaging head 222 provide a means for causing a high velocity stream of air to pass through or close to the surface to be cleaned to entrain dirt and other materials on or in that surface. In addition, flat 246 includes a recess 252 adjacent and parallel to the rear edge of channel 248 adapted to retain a flexible and resilient strip brush 254. Brush 254 is biased outwardly in a direction perpendicular to flat 246 by springs 256 disposed between the head interior and strip brush 254. To facilitate easy movement of head 222 along the surface to be cleaned, flat 246 includes a plurality of wheels 258, proportionally spaced about in flat 246.

Figure 12:
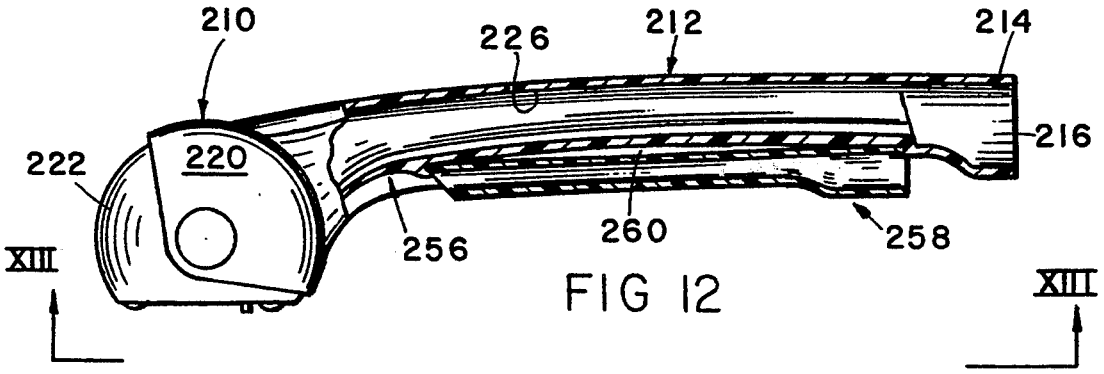
Figure 13:
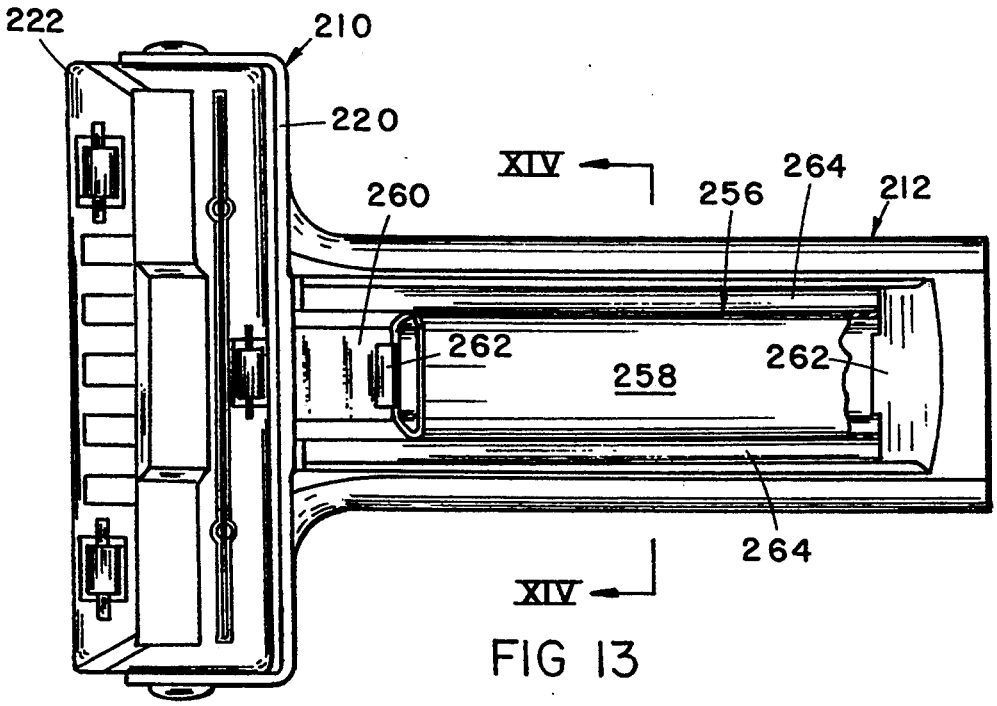
Figure 14:
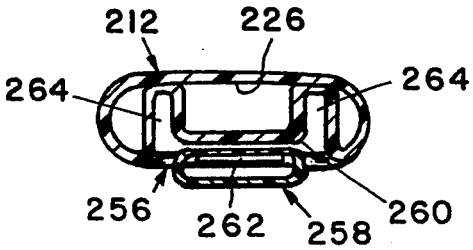

Nested in lower surface 256 of neck 212 is at least one accessory cleaning tool such as crevice tool 258. In a preferred embodiment, crevice tool 258 is retained within recess, depression, or trough 260 in surface 256 by detents 262 which engage each end of crevice tool 258. As shown in FIGS. 12 and 13, recess 260 is preferably located along a longitudinal centerline extending the length of tool 16, to partially conceal accessory tool 258 and not interfere with the blow molding technique and design of tool 16. In transverse section (FIG. 13), recess 260 is bordered by channels 264 actually formed by the compression of the plastic tube used to form tool 16. Channels 264 also make tool 16 more rigid and also define the dimensions of passage 226 which runs from cavity 216 at the rear to opening 228 in shroud 220.

In operation, the desired configuration is selected by the operator to suit the cleaning task to be performed. For example, if vacuum 10 is desired to be used in a hand vacuum configuration, knob 194 is rotated to release dirt cup 14 such that it may be retracted a predetermined distance within housing 12. If a small area is to be cleaned, foot 16 may be removed from the end of dirt cup 14 by simply pulling on the pressure connection. With dirt cup 14 in a retracted position within housing 12, the operator holds vacuum 10 by grasping grip position 34 of handle 30 locating the center of gravity below the operator's hand and slightly forward, such that end face 168 of dirt cup 14 may be naturally placed substantially parallel to the surface to be cleaned. With the operator gripping position 34, the vacuum may be easily actuated by sliding to and aft switch 32. For areas out of reach of the user, dirt cup 14 may be extended by rotating knob 194 to disengage dirt cup 14. The dirt cup may then be extended to the desired length and locked into position by rotating knob 194. The operator may then actuate vacuum 10 and perform the cleaning task.

For cleaning large surface areas such as a floor, the operator moves dirt cup 14 to its fullest extension and locks it in place. The operator may also attach cleaning foot 16. Foot 16 is retained on the end of dirt cup 14 by a friction coupling between cavity 216 and insert 156. The operator may stand upright, grasping vacuum 10 at grip position 36, thus locating the center of gravity substantially below and forward of the grip position to aid in moving the vacuum along the surface to be cleaned. Because the dirt cup extends, a substantial portion of the vacuum weight is retained near the compound handle, making for easy manipulation of the vacuum. Because the dirt cup extends instead of moving the vacuum body further from the user, this invention provides all the advantages of a stick-like vacuum, but without the stick and associated weight shift.

In order to vacuum areas too narrow for cleaning tool 16, or even nozzle insert 156, accessory cleaning tool 258 is used. Floor cleaning tool 16 is removed from insert 156. Accessory cleaning tool 258 is detached from surface 256 and inserted into orifice 170. Accessory cleaning tools offer a wide variety of cleaning characteristics and are well known. In this particular embodiment, accessory tool 258 is a crevice tool having a long, thin, rectangular tube. The end received within orifice 170 forms a substantially tight seal, causing the suction created by the vacuum to be concentrated at the open end of crevice tool 258. When not in use, crevice tool 258 or other accessory is removed from orifice 170 and relocated in trough 260 and retained therein by detents 262 snapped into opposite ends of tool 258.

To evacuate dirt and debris contained in vacuum 10, foot 210 may be removed and dirt cup 14 completely withdrawn from housing 12. Dirt cup 14 is released from housing 12 by disengaging plunger 174 and pulling dirt cup 14 from end 112 of casing 53. With dirt cup 14 removed, filter assembly 146 may be withdrawn from first end 144 by pinching ribs 149, 151. Spun-bonded, polypropylene filter 152 may be removed from frame 148 and washed or otherwise cleaned to remove dirt and debris. Filter 152 may be replaced on frame 148 such that ribs 150 extend into filter 152. With filter assembly 146 withdrawn from dirt cup 14, dirt and debris not entrained in filter 152 may be emptied into another container. Filter assembly 146 is then reinserted into first end 144 such that locking tabs 147 engage recesses in the first end 140 of dirt cup 142 and dirt cup 14 is then reinserted into housing 12. Operation resumes as outlined above.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A vacuum cleaner, comprising:

a housing having a nozzle;

a floor cleaning tool having one end detachably coupled to an end of said nozzle, said floor cleaning tool including an elongate neck having an exterior surface, said neck terminating in a floor engaging head pivotal about an axis transverse to said elongate neck;

a shallow depression defined in said exterior surface of said elongate neck and extending generally the length of said elongate neck, said shallow depression having a pair of attachment members, each at an opposite end of said shallow depression; and an accessory cleaning tool having first and second ends, each detachably retained in said depression by said attachment members, whereby said accessory cleaning tool is detachable from said floor cleaning tool for attachment to said end of said nozzle in place of said floor cleaning tool.

2. The vacuum cleaner as defined in claim 1, wherein each attachment member includes a detent at one end of said depression for detachably retaining said accessory tool in said depression.

3. The vacuum cleaner as defined in claim 1, wherein said elongate neck includes a generally oval transverse cross section defining a generally flat lower exterior surface containing said depression.

4. The vacuum cleaner as defined in claim 1, wherein said depression is bounded by channels formed in said lower exterior surface to define at least one interior passage extending the length of said elongate neck for transporting debris from the floor cleaning tool to said nozzle of the vacuum cleaner.

5. The vacuum cleaner as defined in claim 1, wherein said floor cleaning tool further includes a shroud extending from an opposite end of said elongate neck and partially enclosing a floor engaging head, pivotally coupling said floor engaging head at opposite ends so that said floor engaging head pivots about an axis generally concentric with said shroud.

6. A floor cleaning tool for a vacuum cleaner, comprising:

an elongate neck having a generally oval transverse cross section, and with an opening at one end to be detachably coupled to a nozzle of the vacuum cleaner;

a floor engaging head attached to an opposite end of said elongate neck, and pivotal about an axis transverse to said elongate neck, said floor engaging head including an opening for transporting debris from a surface being cleaned into said elongate neck and the vacuum cleaner;

said elongate neck having a lower exterior surface containing a shallow depression extending generally the length of said elongate neck;

a pair of attachment members, each located at an opposite end of said shallow depression: and an accessory cleaning tool received in said depression and retained therein at opposite ends by said attachment members, and removable from said depression for attachment to said nozzle of the vacuum cleaner, said accessory cleaning tool substantially contained in said shallow depression to maintain said generally oval transverse cross section.

7. The floor cleaning tool as defined in claim 6, further including a shroud extending from an end of said elongate neck opposite said opening, and at least partially enclosing said floor engaging head.

8. The floor cleaning tool as defined in claim 6, wherein said accessory cleaning tool is a crevice tool.

9. The floor cleaning tool as defined in claim 6, further including at least one interior passage extending the length of said floor cleaning tool, interconnecting said nozzle of the vacuum cleaner with said floor engaging head, said at least one interior passage formed from at least one channel paralleling said shallow depression and formed in said exterior surface of said elongate neck.

10. A floor cleaning tool for a vacuum cleaner, comprising:

an elongate neck having one end detachably coupled to the vacuum cleaner, and an opposite end terminating in a housing having an axis generally transverse to said elongate neck;

a floor engaging head concentrically disposed within said housing and pivotal about said transverse axis;

a shallow trough formed in a lower exterior surface of said elongate neck and extending generally along the length of said elongate neck, said trough adapted at opposite ends to detachably retain at least one accessory cleaning tool; and at least one interior passage extending the length of the floor cleaning tool, formed therein by at least one channel extending into said elongate neck from said lower exterior surface and generally parallel to said trough.

11. The floor cleaning tool as defined in claim 10, wherein said elongate neck and housing are molded from a polymeric material.

12. The floor cleaning tool as defined in claim 10, further including a channel bounding opposite sides of said depression and paralleling the length of said elongate neck, each channel extending into said elongate neck to define said at least one interior passage and to define sides of said depression for receiving said accessory cleaning tool.

* * * * *